US006010259A

United States Patent [19]

Hadley

[11] Patent Number: 6,010,259

[45] Date of Patent: Jan. 4, 2000

[54] DONOR RIBBON AND METHOD OF MAKING SAME

[75] Inventor: Keith A. Hadley, Rochester, N.Y.

[73] Assignee: Eastman Kodak Company, Rochester, N.Y.

[21] Appl. No.: 09/124,691

[22] Filed: Jul. 29, 1998

Related U.S. Application Data

[62] Division of application No. 09/054,600, Apr. 3, 1998.

[51] Int. Cl.[7] ..... B41J 31/00

[52] U.S. Cl. ..... 400/240.3; 400/240.4; 347/178

[58] Field of Search ..... 400/240, 240.1, 400/240.2, 240.3, 240.4, 237; 347/176, 177, 178

[56] References Cited

U.S. PATENT DOCUMENTS

| | | | |
|---|---|---|---|
| 4,558,329 | 12/1985 | Honda | 346/76 PH |
| 5,144,331 | 9/1992 | Amano | 346/1.1 |
| 5,162,816 | 11/1992 | Yorozu | 346/76 PH |
| 5,501,537 | 3/1996 | Kohno | 400/240.4 |
| 5,769,549 | 6/1998 | Kouzai | 400/240.4 |
| 5,820,274 | 10/1998 | Fukuoka et al. | 400/120.02 |

*Primary Examiner*—Edgar Burr
*Assistant Examiner*—Dave A. Ghatt
*Attorney, Agent, or Firm*—Walter S. Stevens

[57] ABSTRACT

A donor ribbon and method capable of detecting donor ribbon type and aligning color patches relative to a print head. A dye donor ribbon having a predetermined width includes a plurality of donor color patches thereon. Separating adjacent ones of the patches is a space in which is formed a first stripe extending the entire width of the ribbon. The first stripe defines borders between the adjacent color patches. A second stripe of a predetermined width together with the first stripe are disposed in the space before a beginning one of the color patches to define a beginning sequence of color patches. The second stripe is adjacent to and spaced-apart from the first mark by a predetermined distance and also extends the width of the ribbon parallel to the first stripe. A ratio of the width of the second stripe to the distance between the second stripe and its adjacent first stripe is unique to each donor type and is used to inform the printer of the specific donor type loaded into the printer. In addition, presence of the first stripe between adjacent donor patches defines the beginning borders of each donor patch, so that each donor patch is precisely alignable with the print head.

10 Claims, 2 Drawing Sheets

DONOR RIBBON AND METHOD OF MAKING SAME

CROSS-REFERENCE TO RELATED APPLICATIONS

This is a divisional of application Ser. No. 09/054,600, filed Apr. 3, 1998, entitled "Thermal Printer and Method for Detecting Donor Ribbon Type and for Aligning Color Patches Relative to a Print Head" in the name of Keith A. Hadley.

BACKGROUND OF THE INVENTION

The present invention generally relates to printer apparatus and methods and more particularly relates to a donor ribbon and method capable of detecting donor ribbon type and aligning color patches relative to a print head.

Color thermal printers form a color print by successively printing with a dye donor onto a dye receiver, where the dye donor includes a repeating series of color patches. The print head of a thermal printer commonly provides a print line of individual elements that can be individually heated to thermally transfer dye from the color patches to the dye receiver. Such print heads may take any one of several forms including resistive element, resistive ribbon and laser print heads.

A typical thermal printer includes a platen as well as a print head. A dye donor and a dye receiver are sandwiched between the print head and the platen. An image is printed by selectively heating the individual elements of the print head to transfer a first dye to the dye receiver. The dye receiver is then repositioned to receive a second color of the image, and the dye donor is positioned to provide a second dye color. These steps are repeated until all colors of the image are printed and the completed print is ejected from the printer.

However, proper alignment of each dye donor patch to the print head is important. Proper alignment is important to precisely registering all colors in order to achieve a quality print. In addition, proper identification of type of donor is important so that the printer is informed of the desired mode of operation consistent with the type of donor being used. Informing the printer of the desired mode of operation allows the printer to accommodate a specific type of donor ribbon or inform an operator of the printer apparatus that an improper type of donor ribbon is loaded into the printer. In this regard, types of donor ribbon may differ by such characteristics as ribbon width, patch length, length between repeating sequences of patches, and other characteristics. Such other characteristics may include (a) whether or not a laminate patch is included, and (b) the type of dye set (e.g., photographic dye set versus graphic arts dye set).

As stated hereinabove, proper alignment of each dye color patch to the print head is important. One approach for aligning a color patch to a print head utilizes a detectable mark provided on the dye donor to indicate the start of a color group or color patch. In this regard, a detection mark is a symbol or collection of a small number of marks, such as a bar code, which conveys information. Such detection marks may be produced using optical, magnetic, electrical, tactile or any other method that is easily readable.

A dye donor web with two series of detection marks is disclosed in U.S. Pat. No. 4,496,955 titled "Apparatus For Thermal Printing" issued Jan. 29, 1985, in the name of Sadao Maeyama, et al. According to this patent, a first series of detection marks identifies the beginning of a color group and a second series of detection marks identifies the beginning of each color patch. The first series of detection marks is on one longitudinal edge of the web. The second series of detection marks is on the opposite longitudinal edge of the web. That is, the two series of detection marks are on opposite longitudinal edges of the web. Thus, two detection mark sensors, one for each series of marks, are located downstream of the print line. Use of two detection mark sensors, rather than a single sensor, increases the number of components in the printer and complexity of printer assembly, thus increasing manufacturing costs. Hence another problem in the art is increased printer manufacturing costs.

Moreover, it is desirable to inform the printer of the type of dye donor disposed in the printer, so that the printer produces satisfactory prints. However, Maeyama et al. (U.S. Pat. No. 4,496,955) do not disclose means for determining dye donor type. Therefore, yet another problem in the art is difficulty in determining dye donor type.

In addition, it is desirable to avoid so-called "registered slitting" during manufacture of the donor ribbon. Avoiding registered slitting reduces manufacturing costs. In this regard, during manufacture, a "master roll" of donor is made. Each donor patch extends across the width of this master roll, which may have a width of 45 to 48 inches (i.e., 114.30 cm to 121.92 cm). During the manufacturing process, the master roll is slit lengthwise to produce a plurality of ribbons having widths sized for use in various thermal printers.

However, if detection marks are to be located on opposite longitudinal edges of the finished donor ribbon, then the slit must be precisely registered between the marks during slitting of the master roll. Such "registered slitting" of the master roll is time consuming and may require specialized equipment to perform precise slitting. This increases manufacturing costs.

Therefore, there has been a long-felt need to provide a donor ribbon and method capable of detecting donor ribbon type and aligning color patches relative to a print head.

SUMMARY OF THE INVENTION

The invention resides in a ribbon having a predetermined width, comprising a plurality of sequentially arranged thermally activatable color patches thereon defining a space separating adjacent ones of the patches; and a first mark and a second mark formed in the space and extending the width of the ribbon, said first mark defining borders between adjacent patches, said second mark disposed adjacent to said first mark to define a beginning of a sequence of said patches, wherein said second mark has a width of a predetermined first dimension and wherein said first mark and said second mark are spaced-apart by a predetermined second dimension, whereby a ratio of the first dimension to the second dimension identifies type of the ribbon.

In one aspect of the present invention, a movable dye donor ribbon having a predetermined width comprises a repeating series of sequentially arranged thermally activatable color patches, which may be yellow, magenta and cyan color patches. Separating adjacent ones of the patches is a space in which is formed a continues first mark in the form of a stripe extending the entire width of the ribbon. The purpose of the first mark is to define borders between the adjacent color patches. The first mark is detectable by means of a single sensor, which may be an optical sensor or magnetic sensor depending on whether the first mark is optically or magnetically detectable. In addition, a second mark having a predetermined width together with one of the first marks are disposed in the space before a beginning one of the color patches (e.g., the yellow color patch) to define a beginning sequence (i.e., series) of color patches. More specifically, the second mark, which is disposed adjacent to the first mark, is spaced-apart from the first mark by a predetermined distance and also extends the width of the ribbon parallel to the first mark. The second mark is also detectable by means of the sensor. However, due to the fact that the first mark and the second mark continuously extend the entire width of the ribbon, only a single sensor is necessary for detecting the marks, rather than the two sensors of the prior art. A ratio of the distance between the first mark and the adjacent second mark to the width of the second mark is used to inform the printer of donor type loaded into the printer by an operator thereof. This is so because each donor type is assigned a priori a unique value for the ratio. This unique value of the ratio corresponds to a specific donor type. Also, presence of the first mark between adjacent donor patches define beginning of each donor patch, so that each donor patch is precisely alignable with the print head.

An object of the present invention is to provide a donor ribbon and method capable of detecting donor ribbon type and aligning color patches relative to a print head.

A feature of the present invention is the provision of a continuous first mark extending across the width of a dye donor ribbon and formed between adjacent dye donor patches for defining borders between the donor patches.

Another feature of the present invention is the provision of a continuous second mark of a width having a first dimension and extending across the ribbon, the second mark disposed adjacent to the first mark and spaced-apart therefrom by a distance having a second dimension, a ratio of the second dimension to the first dimension uniquely identifying dye donor type.

Still another feature of the present invention is the provision of the first mark adjacent to the second mark for defining beginning of a series of color patches.

An advantage of the present invention is that manufacturing costs are reduced due to avoidance of "registered slitting" during manufacture of the donor ribbon.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DESCRIPTION OF PREFERRED EMBODIMENTS OF THE INVENTION

The present description will be directed in particular to elements forming part of, or cooperating more directly with, apparatus in accordance with the present invention. It is to be understood that elements not specifically shown or described may take various forms well known to those skilled in the art.

However, in order to fully appreciate the invention, operation of a thermal resistive printer will first be described.

Figure 1:
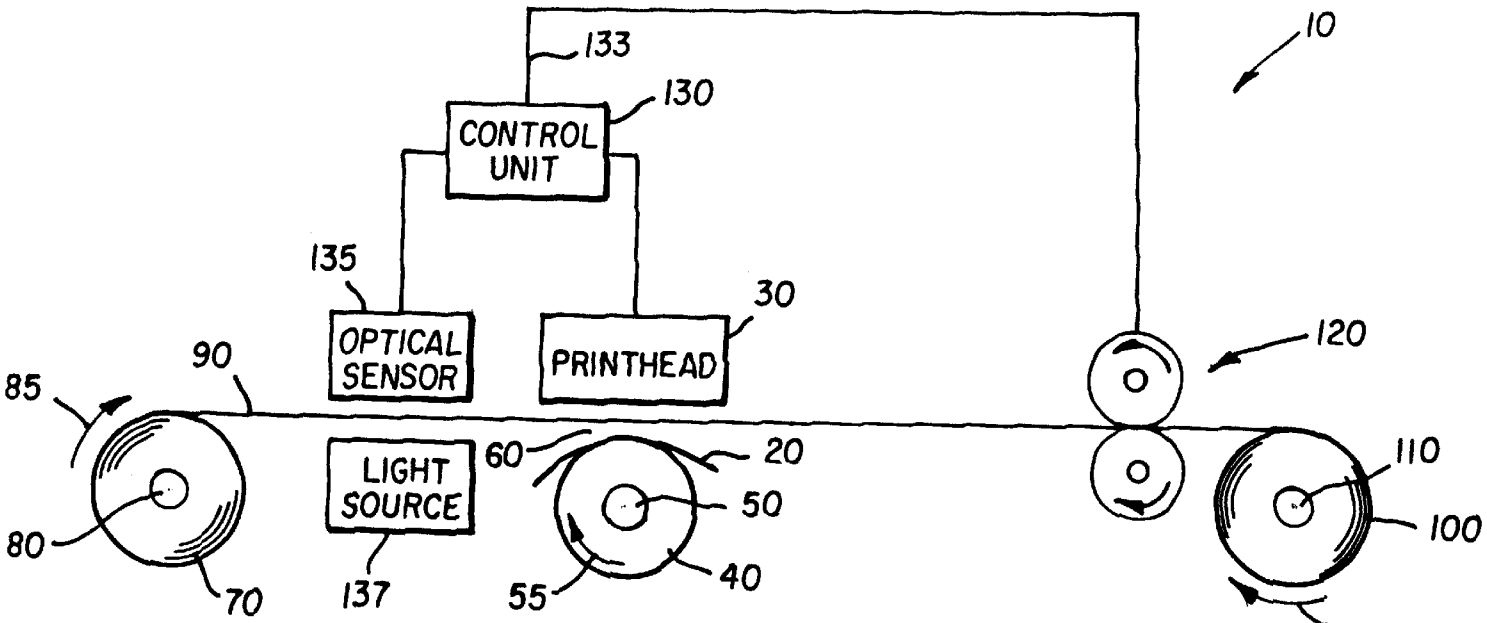
FIG. 1 is a schematic view of a first thermal printer.

Therefore, referring to FIG. 1, there is shown a first thermal resistive printer, generally referred to as 10, for forming an image on a receiver 20, which may be paper or transparency. Printer 10 comprises a thermal resistive print head 30 formed of a plurality of resistive heating elements (not shown). Disposed opposite print head 30 is a generally cylindrical platen 40 adapted to rotate about a first axle 50 in a direction of a first arrow 55. In this regard, platen 40 may be connected to a variable speed reversible motor (not shown) for rotating platen 40. Print head 30 and platen 40 define a collapsible nip 60 therebetween for passage of receiver 20 therethrough. Nip 60 is capable of being closed and opened when platen 40 is upwardly and downwardly moved, respectively, with respect to print head 30. Alternatively, nip 60 may be closed and opened when print head 30 is downwardly and upwardly moved, respectively, with respect to platen 40. In any event, receiver 20 is reversibly transported through nip 60 by means of engagement with rotatable platen 40. As receiver 20 is reversibly transported through nip 60, the nip 60 is closed and the previously mentioned heating elements are activated to cause printing of the image onto receiver 20.

Printer 10 further comprises a dye donor supply spool 70 adapted to rotate about a second axle 80 in a direction of a second arrow 85. Wound about donor supply spool 70 is a movable dye-containing dye donor ribbon 90, the characteristics of which are described more fully hereinbelow. Disposed relative to donor supply spool 70 is a dye donor take-up spool 100 adapted to rotate about a third axle 110 in a direction of a third arrow 115. Donor supply spool 70 supplies dye donor ribbon 90 from donor supply spool 70 to take-up spool 100. It may be understood that as donor supply spool 70 supplies dye donor ribbon 90 to take-up spool 100, ribbon 90 will be suspended between spools 70 and 100 and pass through nip 60 between receiver 20 and print head 30. It may be further understood that as nip 60 closes, the previously mentioned heating elements in print head 30 are enabled such that radiative heat therefrom causes dye to transfer from ribbon 90 to receiver 20 in order to form the image on receiver 20. Moreover, engaging ribbon 90 is a transport mechanism, generally referred to as 120, for transporting ribbon 90 past print head 30. Thus, transport mechanism 120 transports ribbon 90 from supply spool 70, through nip 60, and to take-up spool 100. Alternatively, ribbon 90 may be driven by take-up spool 100 rather than by transport mechanism 120. In this case, transport mechanism 120 would be absent and take-up spool 100 would be connected to a suitable motor (not shown). In other words, as ribbon 90 is sandwiched between print head 30 and platen 40, an image is printed by selectively heating individual ones of the heating elements in print head 30 in order to transfer a first dye to receiver 20. The receiver is then repositioned to receive a second color of the image, and ribbon 90 is positioned to provide a second dye color. These steps are repeated until all colors of the image are printed and the completed print is ejected from printer 10.

Still referring to FIG. 1, movement of ribbon 90 through nip 60 and enablement of the heating elements in print head 30 are preferably synchronized to transfer the dyes from ribbon 90 to receiver 20 at the desired times and predetermined locations on receiver 20. Therefore, a control unit 130 is connected to print head 30 for controlling print head 30, so that the heating elements are enabled when desired. Also, control unit 130 may be connected to print head 30 for upwardly and downwardly moving print head 30 in order to open and close nip 60 when required. Control unit 130 is also connected, such as by means of a cable 133, to transport mechanism 120 for controlling transport mechanism 120, so that operation of transport mechanism 120 is synchronized with the operation of print head 30. Moreover, control unit 130 is connected to a single optical sensor 135 for controlling optical sensor 135, the purpose of which is disclosed hereinbelow. Optically coupled to optical sensor 135 is a light source 137 capable of emitting light detectable by optical sensor 135.

The discussion hereinabove provides a description of a thermal resistive printer that activates ribbon 90 to print an image on receiver medium 20. However, it is desirable to precisely align ribbon 90 with respect to print head 30 each time a color plane is printed. This is desirable in order to obtain a satisfactory print. As described hereinbelow, ribbon 90 is configured to provide such proper alignment. Moreover, it is desirable to detect donor ribbon type. This is desirable in order to avoid loading an improper type of donor ribbon into a specific printer. As described hereinbelow, ribbon 90 is also configured to avoid loading an improper type of donor ribbon into a specific printer.

Figure 2:
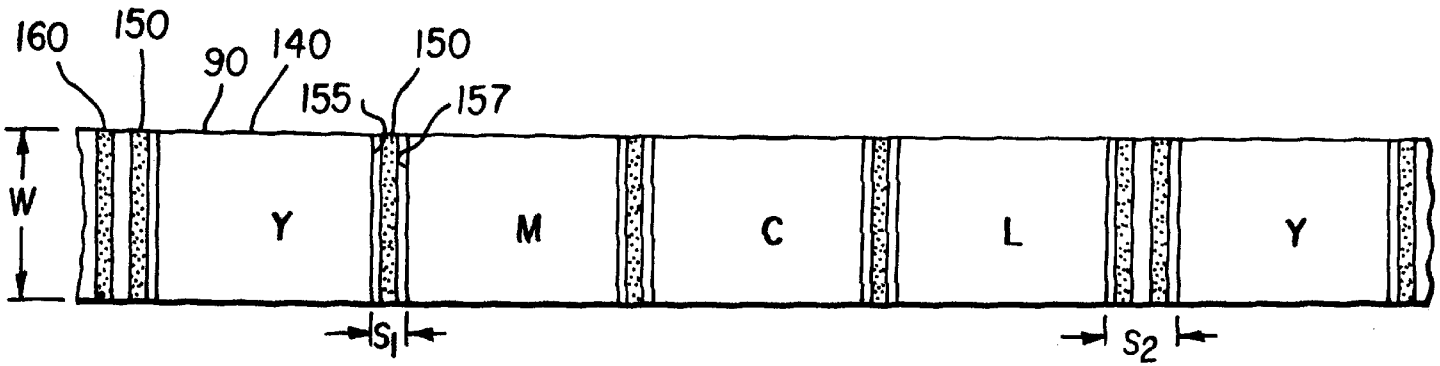
FIG. 2 is a view illustrating a dye donor ribbon having a plurality of sequentially arranged thermally activatable color patches thereon.
Figure 3:
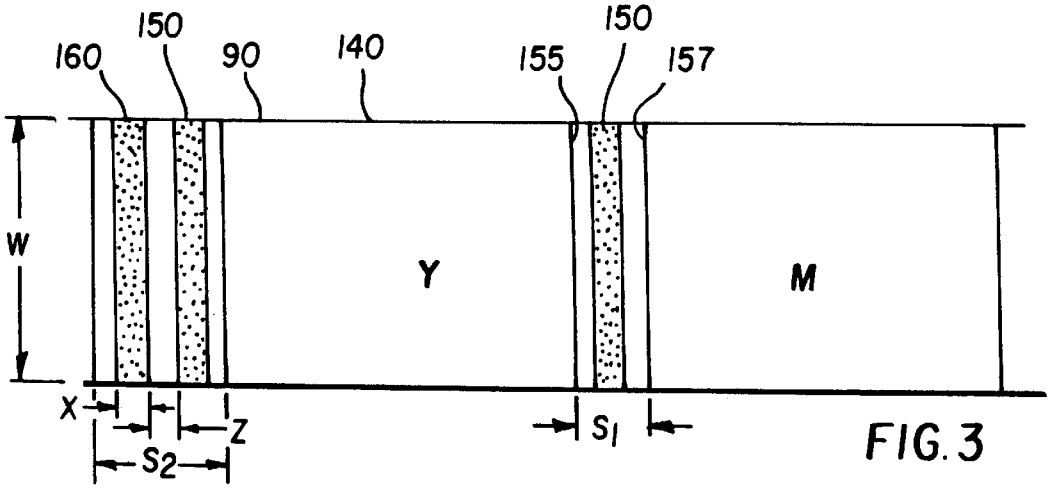
FIG. 3 is a view illustrating two of the color patches, this view also illustrating a first mark defining borders between color patches and a first mark/second mark combination defining beginning of a sequence of color patches.

Therefore, referring to FIGS. 2 and 3, movable ribbon 90 has a predetermined width "W" and also has a plurality of sequentially arranged thermally activatable color patches 140 thereon. By way of example only, and not by way of limitation, color patches 140 may be "Y", "M" and "C" dye color patches comprising the colors yellow, magenta and cyan, respectively. In addition, a heat activatable laminate patch "L" may be present, if desired, which is used to apply a laminate protective layer onto receiver 20 after a completed image is formed thereon. The function of such a laminate layer is to protect the image from damage. Moreover, patches 140 define a space "$S_1$" separating adjacent ones of patches 140 and a space "$S_2$" before a first patch (e.g., the "Y" patch) in the series of patches 140. In the preferred embodiment of the invention, spaces "S1" and "S2" are substantially transparent to light.

Referring to FIGS. 1, 2 and 3, it is known, as previously mentioned, that alignment of each color patch 140 to print head 30 is important to achieve a quality printed image. In this regard, as used herein, the terminology "alignment" refers to locating two independent elements in specific positions with respect to each other. Also, as previously mentioned, it is known that it is desirable to determine type of donor ribbon loaded into printer 10 to achieve a quality printed image. For example, specific types of donor ribbon may differ in such characteristics as (a) whether or not a laminate patch is included and (b) the type of dye set (e.g., photographic dye set versus graphic arts dye set). In addition, it is known that it is desirable to determine the beginning of a sequence of the "Y", "M", "C" and "L" patches to obtain a quality printed image.

Therefore, referring to FIGS. 2 and 3, a space "$S_1$" has a first mark 150 therein extending preferably the entire width "W" of ribbon 90 for defining borders 155 and 157 between adjacent patches 140. In addition, a space "$S_2$" has both first mark 150 and a second mark 160 therein. Spaces "S1" and "S2" are substantially transparent to light but for presence of marks 150/160. More specifically, space "$S_2$" has second mark 160 therein disposed adjacent first mark 150 and also extending the width "W" of ribbon 90 and parallel to first mark 150. Second mark 160 has a width of a predetermined first dimension "X" and is spaced-apart from first mark 150 by a distance of a predetermined second dimension "Z". First mark 150 and second mark 160 are preferably continuous (i.e., without breaks and gaps) and may each be formed in the shape of a straight stripe (as shown) during manufacture of ribbon 90. As described more fully hereinbelow, a combination of first mark 150 and second mark 160 in space "S2" determines beginning of a sequence of patches 140 and also determines type of donor ribbon 90.

Consequently, referring to FIGS. 1, 2 and 3, as light source 137 emits light towards optical sensor 135, the light is intercepted (i.e., blocked) by either first mark 150 or second mark 160. A time threshold "$T_0$" is selected based on the range of velocity at which donor ribbon 90 is moved. More specifically, time threshold "$T_0$" is selected by a process that includes the steps of (a) determining the distance between marks 150/160 by summing the values of first dimension "X" and second dimension "Z" and (b) noting the change in velocity of donor ribbon 90 as take-up spool 100 changes from an empty take-up spool to a full take-up spool. These values are then used to calculate To because it is well known that time equals distance divided by velocity. The value of time threshold "$T_0$" obtained in this manner is used to define borders 155 and 157 in order to properly align individual patches 140 with the previously mentioned heating elements (not shown) in print head 30. The relationship between time threshold "$T_0$", detection of light by sensor 135, and the determination of borders 155 and 157 is illustrated in the following Table 1:

TABLE 1

Relationship Between Time Threshold "$T_0$", Detection Of Light By Optical Sensor, And Determination Of Borders Between Patches

| Sensor Detection Status | Time Since Sensor Last Blocked | Determination Of Borders Between Patches |
|---|---|---|
| Blocked | $<T_0$ | First mark before yellow patch (i.e., yellow patch is first patch) |
| Blocked | $\geqq T_0$ | First mark before "next" patch |
| Not Blocked | $<T_0$ | Sensor disposed within a patch or between second mark and first mark |
| Not Blocked | $\geqq T_0$ | Sensor within a patch |

Still referring to FIGS. 1, 2 and 3, the previously mentioned first dimension "X" and second dimension "Z" are used to determine type of donor ribbon 90. That is, each donor ribbon 90 has second mark 160 with predetermined first dimension "X". Also, each donor ribbon 90 has predetermined second dimension "Z" between first mark 150 and second mark 160. Thus, a ratio "R" obtained by dividing "Z" by "X" is used to obtain a unique identifier associated with a specific donor type. In other words, each specific donor type is assigned a unique numerical identifier represented by ratio "R" that is in turn obtained by dividing the numerical value for the second dimension "Z" by the numerical value for the first dimension "X". Ratio "R" may be calculated by means of a calculator (not shown) connected to control unit 130 or by other suitable means. By way of example only, and not by way of limitation, determination of donor type by calculating ratio "R" is illustrated in the following TABLE 2:

TABLE 2

Determination Of Donor Type By Calculating Ratio "R"

| Donor Type | "X" Dimension (millimeters) | "Z" Dimension (millimeters) | Ratio "R" |
|---|---|---|---|
| #1 | 6 | 18 | 3.000 |
| #2 | 12 | 12 | 1.000 |
| #3 | 18 | 6 | 0.333 |

Figure 4:
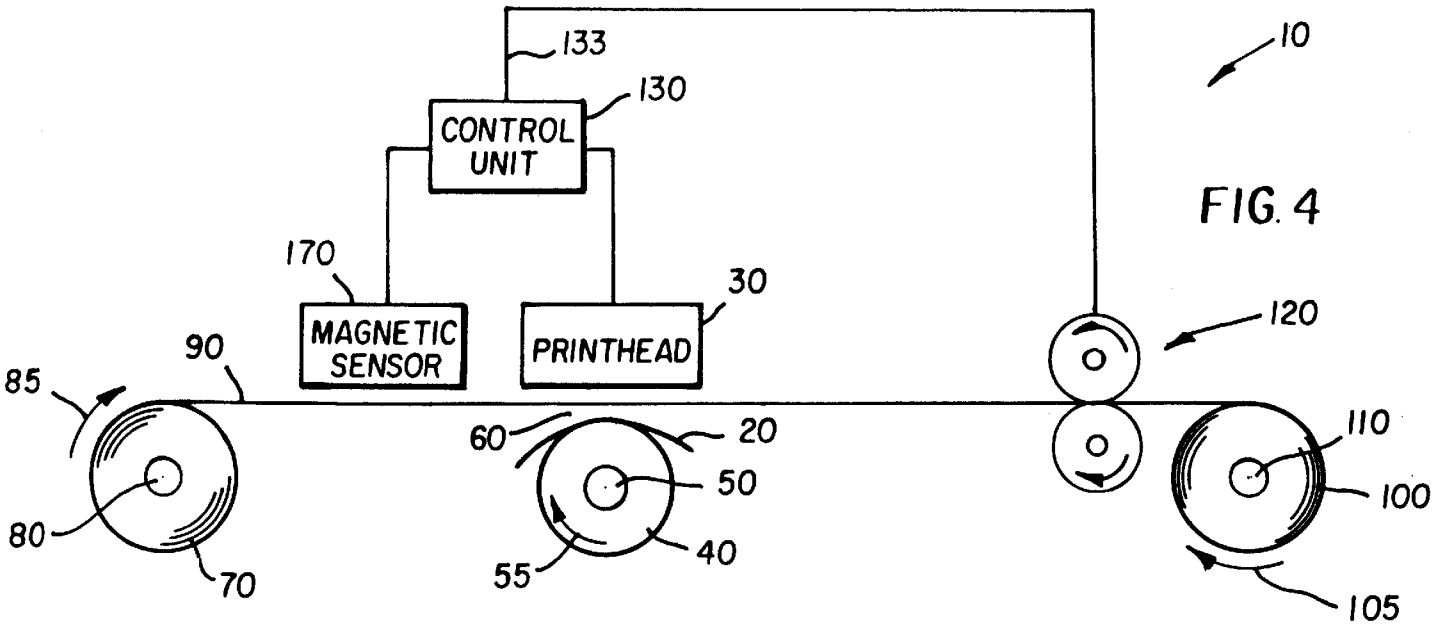
FIG. 4 is a schematic view of a second thermal printer.

Referring to FIG. 4, there is shown a second printer 10, including a magnetic sensor 170. Magnetic sensor 170 is capable of detecting first mark 150 and second mark 160 when marks 150/160 are magnetic. Thus, this second printer 10 differs from the first printer 10 to the extent this second printer is capable of magnetically detecting marks 150/170 rather than optically detecting marks 150/160.

It is understood from the description hereinabove that an advantage of the present invention is that manufacturing costs are reduced due to avoidance of "registered slitting" during manufacture of donor ribbon 90. In this regard, it is known that during the manufacturing process a "master roll" of donor is slit lengthwise to produce individual donor ribbons 90. Due to the continuous nature of marks 150/160, the marks 150/160 preferably extend the width of the master roll. Thus, marks 150/160 preferably extend the entire width "W" of the finished donor ribbon 90. Therefore, the present invention allows slitting at any location of the master roll in order to produce donor ribbons 90 of any desired width. This is in contra-distinction to the prior art which requires precise registration of the slit between marks that are to be located on opposite marginal edges of a donor web.

The invention has been described in detail with particular reference to certain preferred embodiments thereof, but it will be understood that variations and modifications can be effected within the spirit and scope of the invention. For example, although marks 150/160 are disclosed herein as being either optically or magnetically detectable, marks 150/160 may be electrically or tactually detectable, as well.

Moreover, as is evident from the foregoing description, certain other aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

Therefore, what is provided is a donor ribbon and method capable of detecting donor ribbon type and aligning color patches relative to a print head.

PARTS LIST

S1 . . . space between adjacent color patches
S2 . . . space before beginning patch in a series of color patches
W . . . width of dye donor ribbon
X . . . width (first dimension) of second mark
Z . . . distance (second dimension) between first mark and second mark
10 . . . thermal printer
20 . . . receiver medium
30 . . . print head
40 . . . platen
50 . . . first axle
55 . . . first arrow
60 . . . nip
70 . . . dye donor supply spool
80 . . . second axle
85 . . . second arrow
90 . . . dye donor ribbon
100 . . . dye donor take-up spool
110 . . . third axle
115 . . . third arrow
120 . . . transport mechanism
130 . . . control unit
133 . . . cable
135 . . . optical sensor
137 . . . light source
140 . . . color patches
150 . . . first mark
155 . . . first border
157 . . . second border
160 . . . second mark
170 . . . magnetic sensor

What is claimed is:

1. A ribbon having a predetermined width, comprising:

(a) a plurality of sequentially arranged thermally activatable color patches thereon defining a space separating adjacent ones of the patches; and (b) a first mark and a second mark formed in the space and extending the width of the ribbon, said first mark defining borders between adjacent patches, said second mark disposed adjacent to said first mark to define a beginning of a sequence of said patches, wherein said second mark has a width of a predetermined first dimension and wherein said first mark and said second mark are spaced-apart by a predetermined second dimension, whereby a ratio of the first dimension to the second dimension identifies tyde of ribbon.

2. The ribbon of claim 1, wherein said color patches contain thermally activatable dye that is thermally activated by a thermal resistive print head disposed in heat transfer communication with a selected one of said patches.

3. The ribbon of claim 2, wherein the ribbon is engaged by a transport mechanism for transporting the ribbon and said patches past the print head.

4. The ribbon of claim 1, wherein said marks are optically sensed by a single optical sensor.

5. The ribbon of claim 1, wherein said marks are magnetically sensed by a single magnetic sensor.

6. A method of making a donor ribbon, comprising the steps of:

(a) arranging a plurality of sequential thermally activatable color patches on the ribbon, the patches defining a space separating adjacent ones of the patches; and (b) forming a first mark and a second mark in the space and extending the width of the ribbon, the first mark defining borders between adjacent patches, the second mark disposed adjacent to the first mark to define a beginning of a sequence of the patches, wherein the second mark has a width of a predetermined first dimension and wherein the first mark and the second mark are spaced-apart by a predetermined second dimension, whereby a ratio of the first dimension to the second dimension identifies type of the ribbon.

7. The ribbon of claim 6, wherein the step of arranging a plurality of patches comprises the step of arranging a plurality of patches containing thermally activatable dye that is thermally activated by a thermal resistive print head disposed in heat transfer communication with a selected one of the patches.

8. The ribbon of claim 6, wherein the step of forming a first mark and a second mark comprises the step of forming a first mark and a second mark that are optically sensed by a single optical sensor.

9. The ribbon of claim 6, wherein the step of forming a first mark and a second mark comprises the step of forming a first mark and a second mark that are magnetically sensed by a single magnetic sensor.

10. The method of claim 6, further comprising the step of slitting the ribbon perpendicularly with respect to the marks for longitudinally dividing the ribbon.

* * * * *